US006056469A

United States Patent [19]

Algorri

[11] Patent Number: 6,056,469

[45] Date of Patent: May 2, 2000

[54] TOOTHBRUSH WITH TOOTHPASTE DISPENSING CASING

[76] Inventor: Mark S. Algorri, 294 S. Grand Ave., Pasadena, Calif. 91105

[21] Appl. No.: 08/636,244

[22] Filed: Apr. 23, 1996

Related U.S. Application Data

[63] Continuation-in-part of application No. 08/340,117, Nov. 15, 1994, abandoned.

[51] Int. Cl.[7] ..... A46B 17/04

[52] U.S. Cl. ..... 401/269; 401/123; 401/124; 401/118

[58] Field of Search ..... 401/191, 125, 401/268, 269, 132, 123, 124, 118; 132/308; 141/328, 373, 370, 320; 222/206, 93, 105, 215

[56] References Cited

U.S. PATENT DOCUMENTS

| | | | |
|---|---|---|---|
| 611,788 | 10/1898 | Lincoln | 401/191 |
| 1,470,129 | 10/1923 | Tichenor | 132/308 |
| 1,862,870 | 6/1932 | Tiscornia | 141/370 |
| 2,100,960 | 11/1937 | Jacoby | 401/123 X |
| 2,312,828 | 3/1943 | Adamsson | 401/268 |
| 2,389,683 | 11/1945 | Page | 141/370 X |
| 2,550,190 | 4/1951 | Greenberg | 401/268 X |
| 2,767,745 | 10/1956 | Wiggin | 141/328 |
| 2,796,875 | 6/1957 | Anastasia | 401/118 X |
| 2,900,650 | 8/1959 | Rivero | 222/215 X |
| 3,165,776 | 1/1965 | Tuseth | 401/132 |
| 3,316,580 | 5/1967 | Tebbs | 401/132 |
| 3,458,268 | 7/1969 | Wozab et al. | 401/268 X |
| 3,734,118 | 5/1973 | Howard | 401/125 X |
| 4,198,171 | 4/1980 | Lampka et al. | 401/269 |
| 4,228,925 | 10/1980 | Mendelovich | 222/105 X |
| 4,974,981 | 12/1990 | Bennett | 401/123 |

FOREIGN PATENT DOCUMENTS

| | | | |
|---|---|---|---|
| 628714 | 10/1927 | France | 401/125 |
| 2554331 | 5/1985 | France | 401/268 |
| 2583625 | 12/1986 | France | 401/132 |
| 2606615 | 5/1988 | France | 401/269 |
| 2696916 | 4/1994 | France | 401/184 |

*Primary Examiner*—David J. Walczak
*Attorney, Agent, or Firm*—McCutchen, Doyle, Brown & Enersen, LLP; Michael J. Shuster

[57] ABSTRACT

A combined toothbrush and toothpaste dispenser is described which is adapted to store toothpaste in a reservoir in the casing of the brush and to deposit a controlled quantity of the stored toothpaste directly onto the brush surface. The toothbrush comprises: (1) a brush 1 having bristles 8 which are attached to and supported by a brush head portion 5 and a handle 2, and (2) a casing 11 made of flexible material containing a reservoir 7 within the casing. The toothbrush is operated by squeezing the casing which causes toothpaste to be deposited from the reservoir onto the bristles. The upper surface of the bristles may have cavities 12 to receive and contain the toothpaste.

10 Claims, 4 Drawing Sheets

TOOTHBRUSH WITH TOOTHPASTE DISPENSING CASING

CROSS REFERENCE TO RELATED APPLICATION

This application is a continuation-in-part of application Ser. No. 08/340,117 filed Nov. 15, 1994, entitled "Toothbrush with Toothpaste Dispensing Casing" now abandoned.

BACKGROUND OF THE INVENTION

1. Field of the Invention

This invention relates to toothbrushes, and more particularly to toothbrushes in which toothpaste is applied to the bristles of the brush by squeezing a toothpaste reservoir in the casing of the head portion of the brush.

2. Description of Prior Art

Conventional toothbrushes require a separate toothpaste tube to distribute toothpaste onto the bristles of the toothbrush. These conventional toothbrushes are generally stored in reasonably sanitary conditions but must be placed in a suitable container when transported.

There are a variety of toothbrushes and toothpaste dispensers in the prior art which store and dispense toothpaste from the handle of the brush. Some of these brushes dispense the toothpaste at the base portion of the brush where the bristles are attached to the brush head support. Patents which describe toothbrushes utilizing this method for dispensing toothpaste to the brush include U.S. Pat. Nos. 4,221,492, 4,116,570 and 4,201,490.

These bottom fed brushes tend to use excessive toothpaste since the toothpaste must be forced through the bristles to reach the surface where it is useful. In addition, brushes of this type are difficult to clean as unused toothpaste has a tendency to become clogged at the base of the bristles. Finally, these toothbrushes tend to be complicated and not economical for the average consumer.

U.S. Pat. No. 3,593,725 describes a toothbrush that contains the toothpaste within the hollow handle of the toothbrush. To use this toothbrush, the handle must be opened and the toothpaste removed from the handle and applied by hand to the bristles. Although this toothbrush does not have the complicated designs and cleaning difficulties of the bottom fed brushes, it still requires several unnecessary parts.

U.S. Pat. No. 4,056,110 also describes a toothbrush and toothpaste dispenser where the toothpaste is directly applied to the bristles of the brush. This brush arrangement contains many mechanical parts, is complicated, and is not economical to manufacture.

SUMMARY OF THE INVENTION

A principle object of the toothbrush of the present invention is to provide an improved toothbrush and toothpaste dispenser of simple and practical construction that is economical to manufacture. The toothbrush provides a simple means for distributing toothpaste onto the bristles of the toothbrush by effecting a discharge of toothpaste from a reservoir in the brush casing through holes in the casing onto the bristles of the brush. The casing prevents the toothbrush from being contaminated when the toothbrush is carried about. As the toothpaste is contained in the reservoir in the brush casing, no separate toothpaste tube is needed. Finally, the brush and casing are easy to clean.

DETAILED DESCRIPTION OF THE INVENTION

Figure 1:
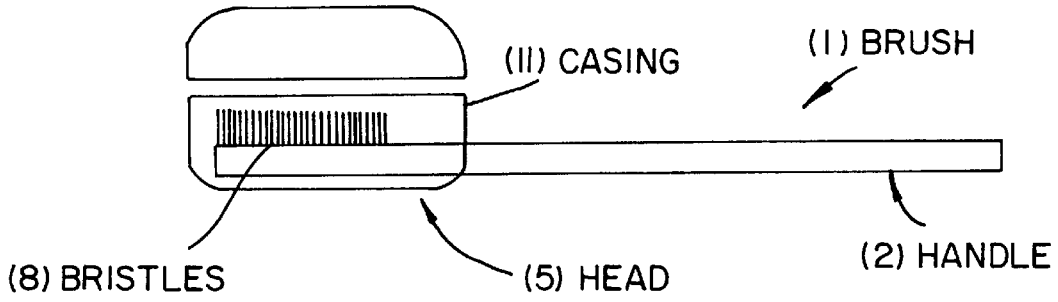
FIG. 1 is a side view of a combined toothbrush and toothpaste dispenser in accordance with one presently preferred embodiment of the invention.
Figure 2:
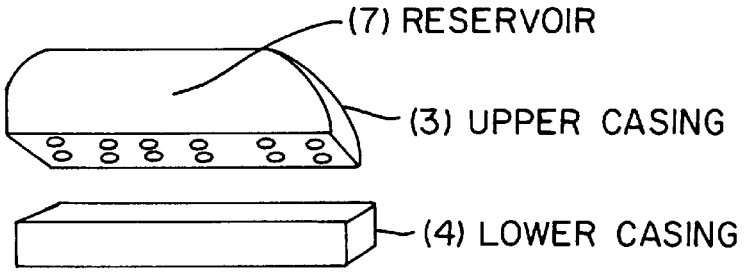
FIG. 2 is a perspective view of the upper and lower casing of the brush in accordance with one presently preferred embodiment of the invention.
Figure 3:
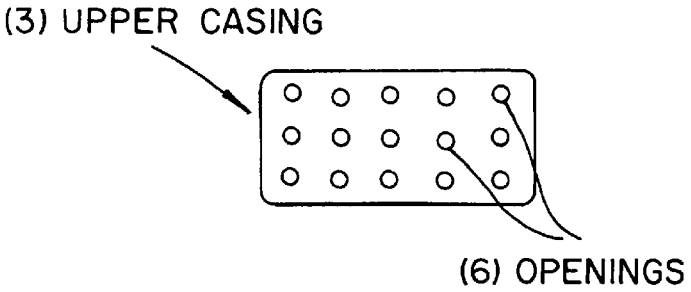
FIG. 3 is a bottom view of the upper casing of the brush.

A typical embodiment of the toothpaste dispensing toothbrush is illustrated in FIGS. 1, 2 and 3.

As shown in FIG. 1, the toothpaste dispensing toothbrush of the invention includes a brush 1, with a handle portion 2, and a head portion 5. A plurality of bristles 8 are positioned on and attached to the upper surface of the head portion 5.

As shown in FIGS. 1 and 2, a protective upper casing 3 and a protective lower casing 4 surround the head portion 5 and bristles 8. When the toothbrush is not being used, the upper casing and lower casing are secured together so that when they are engaged, they form a recess. The head portion of the toothbrush and the bristles are securely enclosed in the hollow recess between the upper and lower casings.

When the toothbrush is to be used, the upper and lower casings are detached and separated such that the head portion of the toothbrush and the bristles are exposed.

As shown in FIG. 2, included within the upper casing is a reservoir 7 used for storing toothpaste. The toothpaste is stored directly in the reservoir. As shown in FIG. 3, the bottom of the upper casing contains a plurality of openings 6 through which toothpaste can be applied from the reservoir onto the top surface of the bristles 8. The upper casing 3 is comprised of flexible material. When the flexible material is squeezed, toothpaste contained in the reservoir moves through the openings onto the top of the bristles. Subsequently, the upper and lower portions of the casing are removed by the user, leaving the brush available for use.

There are various possibilities with regard to the position, size and shape of the openings 6. The openings can be positioned such that when the reservoir is compressed, the toothpaste contained in the reservoir will be applied onto the bristles in the desired manner.

Figure 4:
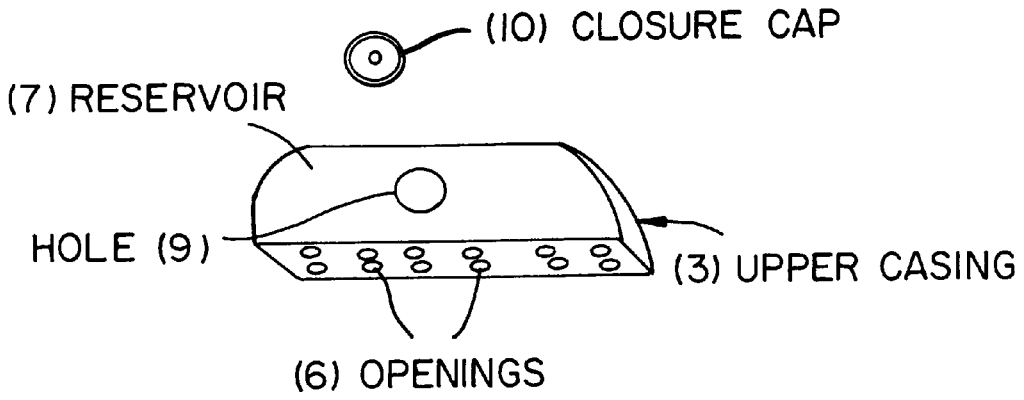
FIG. 4 is a perspective view of a modified version of the upper casing.

In the embodiment described above, the upper casing 3 is a disposable toothpaste cartridge. In a modified form of the toothbrush as shown in FIG. 4, the upper casing 3 has a hole 9 positioned in the surface of the upper casing 3 so that toothpaste can be inserted through the hole 9 into the reservoir 7 contained within the upper casing 3. A closure cap 10 can be inserted in the hole 9 to secure the toothpaste within the reservoir 7 when toothpaste is not being inserted into the reservoir. In this embodiment, the reservoir in the upper casing can be refilled and reused.

Figure 5:
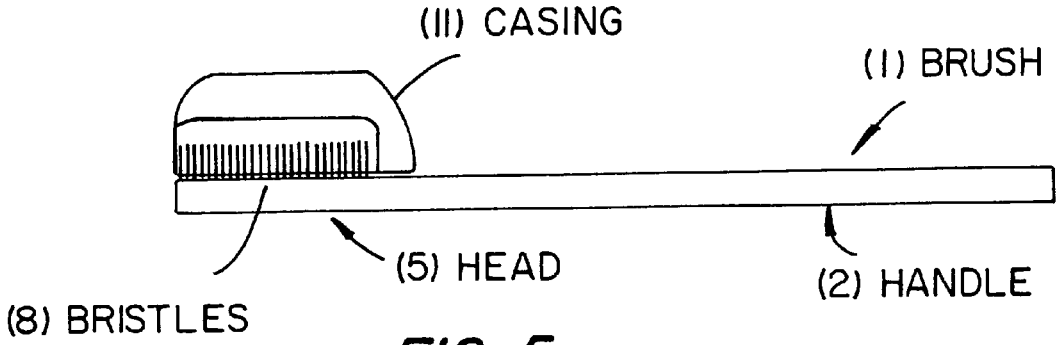
FIG. 5 is a side view of another embodiment of the combined toothbrush and toothpaste dispenser.

In another embodiment, shown in FIG. 5, the casing 11 is comprised of only one component. The casing 11 is secured directly to the head portion 5 of the toothbrush, thereby enclosing the upper surface of the head portion 5 and the bristles. When the toothbrush is not being used, the casing and head are secured together so that when they are engaged, they form a recess to contain the bristles. In this position, the upper surface of the head portion of the toothbrush and the bristles are securely enclosed in the hollow recess between the casing and the sides of the head portion.

Figure 6:
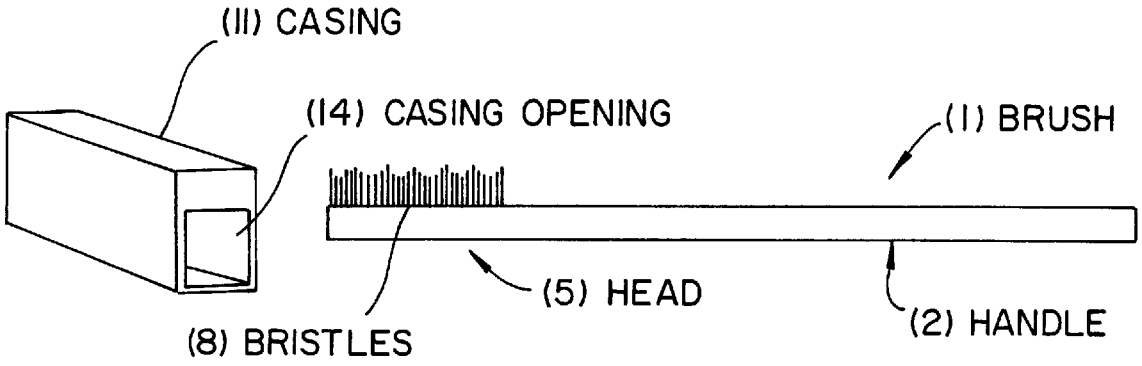
FIG. 6 is a side view of an embodiment of the combined toothbrush and toothpaste dispenser with a slide-on casing.

In another embodiment shown in FIG. 6, the casing 11 has an opening 14 through which the head portion 5 of the toothbrush can be inserted and removed. When the toothbrush is not being used, the head and bristles of the toothbrush are secured within the casing 11. When the flexible top portion of the casing is compressed, toothpaste contained within the reservoir in the top portion of the casing is released from the reservoir and deposited onto the bristles of the toothbrush. The head portion of the toothbrush can then be removed from the casing. In this embodiment, the casing slides off of the head portion rather than detaching from it.

Figure 7:
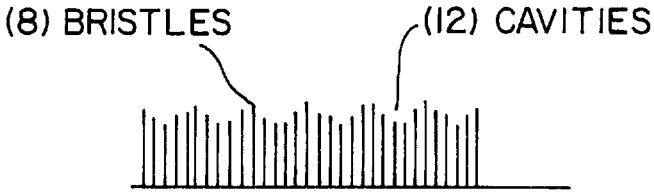
FIG. 7 is a side view of the bristles of the of the combined toothbrush and toothpaste dispenser used with the slide-on casing.
Figure 8:
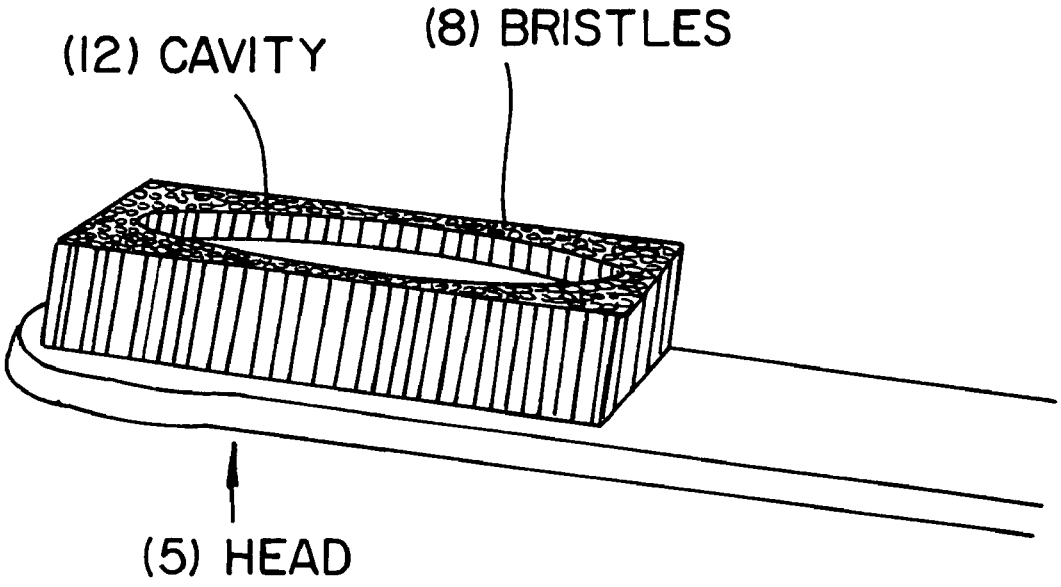
FIG. 8 is a perspective view of an embodiment of a toothbrush having a central cavity for containing toothpaste that is used in combination with a toothpaste dispenser in accordance with the invention.
Figure 9:
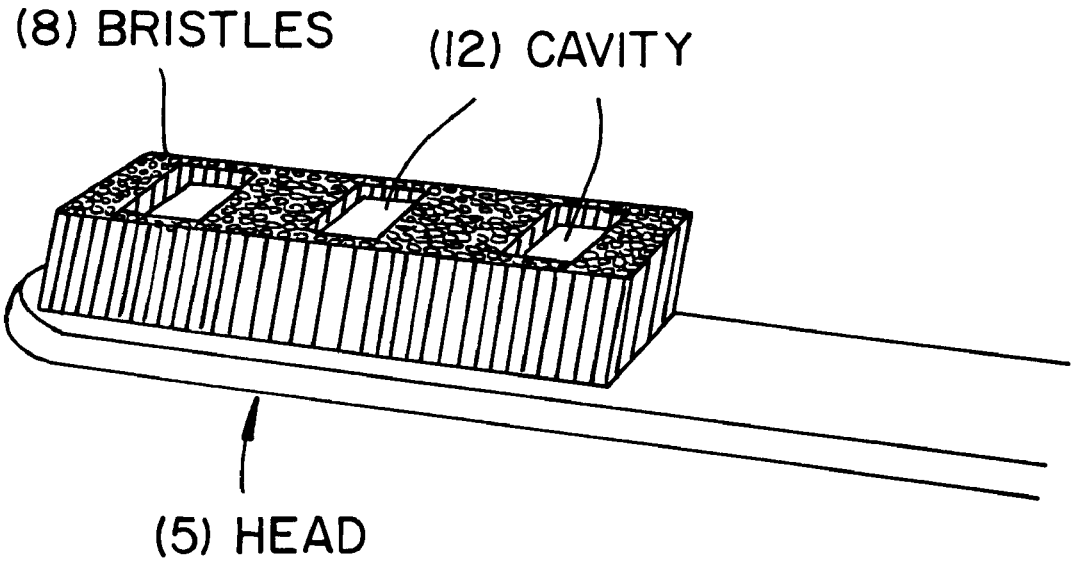
FIG. 9 is a perspective view of another embodiment of a toothbrush having a plurality of cavities for containing toothpaste that is used in combination with a toothpaste dispenser in accordance with the invention.

To prevent the toothpaste from being rubbed off of the bristles when the toothbrush is removed from the casing, the bristles can be formed such that the top surface of the bristles have cavities 12 to capture and contain the toothpaste as the head portion is removed from the casing. As illustrated in FIG. 7, the cavities 12 can be formed with a series of bristles that are of different lengths. FIGS. 8 and 9 illustrate alternative cavity designs. FIG. 8 illustrates a design with one central cavity 12 cut-away in the top portion of the bristles 8. FIG. 9 illustrates an alternative embodiment with three separate cavities 12 cut-away in the top portions of the bristles 8.

Advantages of the toothpaste dispensing toothbrush of the invention are readily apparent from the above description:

(a) The invention is easy to use.

(b) The invention is inexpensive to produce.

(c) The toothpaste can be distributed in any desired manner over the bristles by adjusting the position of the openings in the casing containing the toothpaste reservoir. The amount of toothpaste and the position of the toothpaste deposited on the bristles of the brush can be determined by adjusting the size, shape and position of the openings on the casing.

(d) The design of the invention will prevent breaking or malfunctioning.

(e) The toothbrush is compact, portable, non-obtrusive and easy to transport.

(f) The toothbrush can be removed from the casing without the toothpaste being rubbed off of the bristles.

(g) The casing surrounding the head portion of the brush and the bristles protects the bristles and prevents the head portion and bristles from being contaminated.

(h) The casing may be disposable and therefore easy to replace when empty. Alternatively, the casing may be easily refilled when empty.

The combined toothbrush and toothpaste dispenser of this invention can be used to apply toothpaste to the bristles of the toothbrush easily and conveniently. The toothbrush assembly consisting of the brush and casing forms a complete unit which may be transported, as when traveling, and quickly and easily used. The quantity and position of the toothpaste deposited on the bristles can be adjusted. The toothbrush can be easily cleaned and protected.

While the invention has been described in detail with reference to certain preferred embodiments, the principals involved are susceptible to other applications which will be apparent to those skilled in the art. As illustrated above, various modifications can be effectuated within the spirit and scope of the invention. For example, the upper casing and reservoir can either be replaceable or reusable. If the upper casing is replaceable, when the toothpaste in the upper casing is depleted, the user could obtain another upper casing containing toothpaste. If the upper casing is reusable, the upper casing would contain a means for replacing the toothpaste into the casing. This could be accomplished with a simple hole in the casing which would be opened to refill the reservoir and closed when the toothbrush is being used.

In addition, the casing may be comprised of only one component with the bottom edges of the casing being secured to the head of the brush so as to enclose the bristles in the hollow chamber formed between the casing and the head member.

In addition, the brush and casings can be made in various sizes. For example, a smaller brush and casing could be made for travel purposes while a larger brush and casing could be made for home use.

Therefore, the scope of the invention should be determined by the following claims and their legal equivalents, rather than by the examples given.

I claim:

1. A combined toothbrush and toothpaste dispenser comprising:

a. a brush having a handle with a head portion integral with said handle, b. a plurality of bristles attached to the head portion, forming a bristle surface to support toothpaste, c. a removable deformable casing which, when attached to the head of the brush, encloses the bristles, d. a reservoir situated within the casing capable of containing toothpaste, and e. a plurality of openings on a surface of the casing positioned and distributed above the bristles when the brush is contained in the casing, through which toothpaste in the casing can be deposited onto the bristle surface by squeezing the deformable casing.

2. The combined toothbrush and toothpaste dispenser of claim 1 wherein said casing contains a means for repeatedly introducing toothpaste into the reservoir.

3. The combined toothbrush and toothpaste dispenser of claim 2 wherein the means for introducing toothpaste comprises a. a hole in the deformable casing, and b. a plug to secure the toothpaste in the reservoir when the reservoir is not being refilled.

4. The combined toothbrush and toothpaste dispenser of claim 1 wherein said deformable casing consists of an upper casing and a lower casing which can be secured together, thereby enclosing the head of the brush.

5. A combined toothbrush and toothpaste dispenser comprising:

a. a brush having a handle with a head portion integral with said handle, b. a plurality of bristles attached to the head portion, forming a bristle surface to support toothpaste, c. a removable deformable casing which, when attached to the head of the brush, encloses the head portion of the brush and the bristles, said casing having a recessed portion to contain the head portion and bristles, d. a reservoir situated within the casing capable of containing toothpaste, and e. a plurality of openings on a surface of the casing positioned and distributed above the bristles when the brush is contained in the casing, through which toothpaste in the casing can be deposited onto the bristle surface by squeezing the deformable casing.

6. The combined toothbrush and toothpaste dispenser of claim 5 wherein said casing contains a means for repeatedly introducing toothpaste into the reservoir.

7. The combined toothbrush and toothpaste dispenser of claim 6 wherein the means for introducing toothpaste consists of a. a hole in the casing, and b. a plug to secure the toothpaste in the reservoir when the reservoir is not being refilled.

8. The combined toothbrush and toothpaste dispenser of claim 5 wherein the bristles are of different lengths and are arranged to create one or more cavities on the bristle surface to receive toothpaste.

9. The combined toothbrush and toothpaste dispenser of claim 8 wherein one central cavity is positioned on the bristle surface.

10. The combined toothbrush and toothpaste dispenser of claim 8 wherein multiple cavities are positioned on the bristle surface.

* * * * *